US010587958B2

(12) United States Patent
Zhan et al.

(10) Patent No.: US 10,587,958 B2
(45) Date of Patent: Mar. 10, 2020

(54) SUSPENSION FOR MOVING-COIL LOUDSPEAKER AND LOUDSPEAKER

(71) Applicant: Tymphany HK Limited, Hong Kong (CN)

(72) Inventors: Yu Bing Zhan, Taipei (TW); Hong Zai Xie, Taipei (TW); Shao Lin Yang, Taipei (TW)

(73) Assignee: Tymphany HK Limited, Wanchai (HK)

( * ) Notice: Subject to any disclaimer, the term of this patent is extended or adjusted under 35 U.S.C. 154(b) by 0 days.

(21) Appl. No.: 16/030,058

(22) Filed: Jul. 9, 2018

(65) Prior Publication Data

US 2019/0014418 A1 Jan. 10, 2019

Related U.S. Application Data

(60) Provisional application No. 62/529,855, filed on Jul. 7, 2017.

(51) Int. Cl.

| | |
|---|---|
| ***H04R 25/00*** | (2006.01) |
| ***H04R 9/06*** | (2006.01) |
| ***H04R 9/04*** | (2006.01) |
| ***H04R 9/02*** | (2006.01) |
| ***H04R 7/18*** | (2006.01) |
| ***H04R 7/12*** | (2006.01) |

(Continued)

(52) U.S. Cl.

CPC ..... *H04R 9/06* (2013.01); *H04R 7/04* (2013.01); *H04R 7/127* (2013.01); *H04R 7/18* (2013.01); *H04R 9/025* (2013.01); *H04R 9/043* (2013.01); *H04R 7/20* (2013.01)

(58) Field of Classification Search

CPC . H04R 9/06; H04R 7/04; H04R 7/127; H04R 7/18; H04R 9/025; H04R 9/043; H04R 7/20

USPC ..... 381/398

See application file for complete search history.

(56) References Cited

U.S. PATENT DOCUMENTS 2,069,242 A * 2/1937 Graham ..... H04R 7/20 181/172
2,439,666 A * 4/1948 Marquis ..... H04R 7/20 181/172

(Continued)

FOREIGN PATENT DOCUMENTS

JP 2009159010 A * 7/2009

*Primary Examiner* — Phylesha Dabney
(74) *Attorney, Agent, or Firm* — Muncy, Geissler, Olds & Lowe, P.C.

(57) ABSTRACT

A moving-coil loudspeak includes a vibrating diaphragm, a suspension, a voice coil, a magnetic circuit, and a support. The suspension includes a surround and a first spider. One side of the surround is connected to an outer surface of the vibrating diaphragm. The first spider vertically stands below a connection between the surround and the vibrating diaphragm, and one side of the first spider is connected to an inner surface of the vibrating diaphragm. The voice coil is located below the center of the vibrating diaphragm. The magnetic circuit is located below the voice coil, where a coil on the voice coil is disposed at a central position of a magnetic gap. After the voice coil is powered on, a generated magnetic induction force drives the voice coil to vibrate and produce a sound by using the vibrating diaphragm. The support supports the magnetic circuit.

18 Claims, 4 Drawing Sheets

(51) Int. Cl.
*H04R 7/04* (2006.01)
*H04R 7/20* (2006.01)

(56) References Cited

U.S. PATENT DOCUMENTS

| | | | | | |
|---|---|---|---|---|---|
| 2,490,466 | A * | 12/1949 | Olson | H04R 7/20 | 181/172 |
| 3,019,849 | A * | 2/1962 | King | H04R 7/20 | 181/172 |
| 4,284,167 | A * | 8/1981 | Kozlow | H04R 7/04 | 181/172 |
| 4,547,631 | A * | 10/1985 | Nieuwendijk | H04R 7/20 | 381/161 |
| 4,817,165 | A * | 3/1989 | Amalaha | H04R 7/122 | 181/170 |
| 5,748,759 | A * | 5/1998 | Croft | H04R 7/22 | 181/171 |
| 6,219,432 | B1 * | 4/2001 | Fryer | H04R 7/20 | 181/171 |
| 6,607,051 | B1 * | 8/2003 | Peng | H04R 1/16 | 181/171 |
| 2004/0120542 | A1 * | 6/2004 | Morris, III | H04R 7/20 | 381/396 |
| 2019/0014418 | A1 * | 1/2019 | Bing | H04R 9/06 | |

* cited by examiner

SUSPENSION FOR MOVING-COIL LOUDSPEAKER AND LOUDSPEAKER

CROSS REFERENCE TO RELATED APPLICATIONS

This nonprovisional application claims priority to U.S. Provisional Application No. 62/529,855, which was filed on Jul. 7, 2017, and which is herein incorporated by reference.

BACKGROUND

Technical Field

This application relates to a suspension and a loudspeaker, and in particular, to a suspension for a moving-coil loudspeaker and a loudspeaker.

Related Art

Nowadays, electronics are developed to be light, thin, short, and small. Portable electronics such as multimedia speakers, liquid-crystal display televisions, and home surround speakers that need loudspeakers are made smaller. Loudspeaker makers usually adopt a flat design to provide a lighter, thinner, shorter, and smaller loudspeaker so as to meet requirements.

In the field of loudspeakers, a suspension system consists of a spider and a surround and is used for supporting a core component of a loudspeaker, that is, a vibrating diaphragm. Loudspeaker makers are also devoted to scaling down the suspension. However, once the conventional design is scaled down and flattened to a certain degree, collision between components such as a support, a support cup, and a magnetic circuit is likely to occur during operation of the loudspeaker, thus affecting normal sound production of the loudspeaker or even causing serious distortion.

SUMMARY OF THE INVENTION

In view of above, the present disclosure provides a suspension for a moving-coil loudspeaker and a loudspeaker.

The suspension is used for supporting a vibrating diaphragm, and includes a surround and a first spider. A cross-section view of the surround has an inverted U-shape, and one side of the surround is connected to an outer surface of the vibrating diaphragm. The first spider vertically stands below a connection between the surround and the vibrating diaphragm, and one side of the first spider is connected to an inner surface of the vibrating diaphragm.

In an embodiment, the other side of the surround is thickened to form a step shape. The vibrating diaphragm has an elongate, ellipse-shape, the surround encircles the periphery of the vibrating diaphragm, and the first spider is located on one end of a major axis of the long ellipse. The suspension includes a second spider which is located on the other end of the major axis of the long ellipse, and the second spider vertically stands below a connection between the surround and the vibrating diaphragm. The first spider and the second spider are arc wave plates.

The moving-coil loudspeaker of the present disclosure includes the suspension described above, a vibrating diaphragm, a voice coil, a magnetic circuit, and a support. The voice coil is located below the center of the vibrating diaphragm. The magnetic circuit is located below the voice coil. There is a magnetic gap between the magnetic circuit and the voice coil, and the voice coil is disposed at a central position of the magnetic gap. After the voice coil is powered, a magnetic induction force is generated to drive the voice coil for vibrating and producing a sound by way of the vibrating diaphragm. The support supports the magnetic circuit and includes an edge. The edge corresponds to the surround and is connected to the other side of the surround.

In an embodiment, the other side of the surround is thickened and forms a step shape for connecting to the edge of the support.

In an embodiment, the moving-coil loudspeaker includes a support cup. The support cup includes a central hole and a central edge, a part of the voice coil is passed through the central hole, and the central edge is connected to the voice coil. The entire support cup is long-elliptical cone-shaped and includes an upper opening edge. The upper opening edge is connected to a lower surface of the vibrating diaphragm.

According to the suspension of the moving-coil loudspeaker and the loudspeaker in this application, the entire loudspeaker is made thinner and can achieve a characteristic of large-stroke for mega bass.

DETAILED DESCRIPTION

For reading convenience, "above", "below", "left", and "right" specified in this specification according to the drawings are intended to specify reference relative positions between components rather than limiting the scope of the invention.

Figure 1:
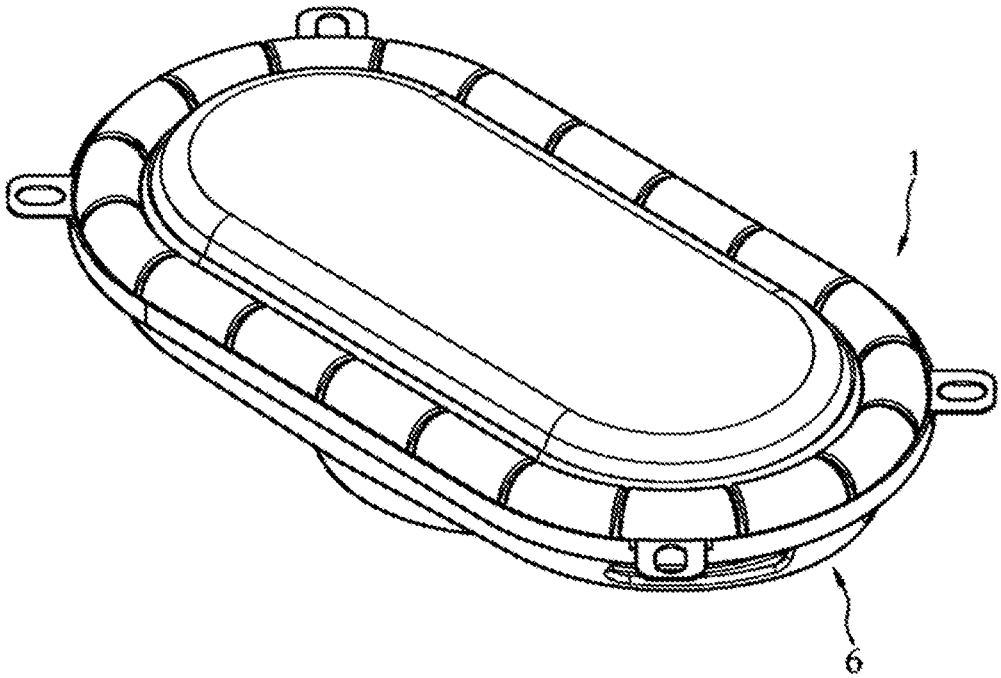
FIG. 1 is a schematic perspective view of an embodiment of a moving-coil loudspeaker according to this disclosure.
Figure 2:
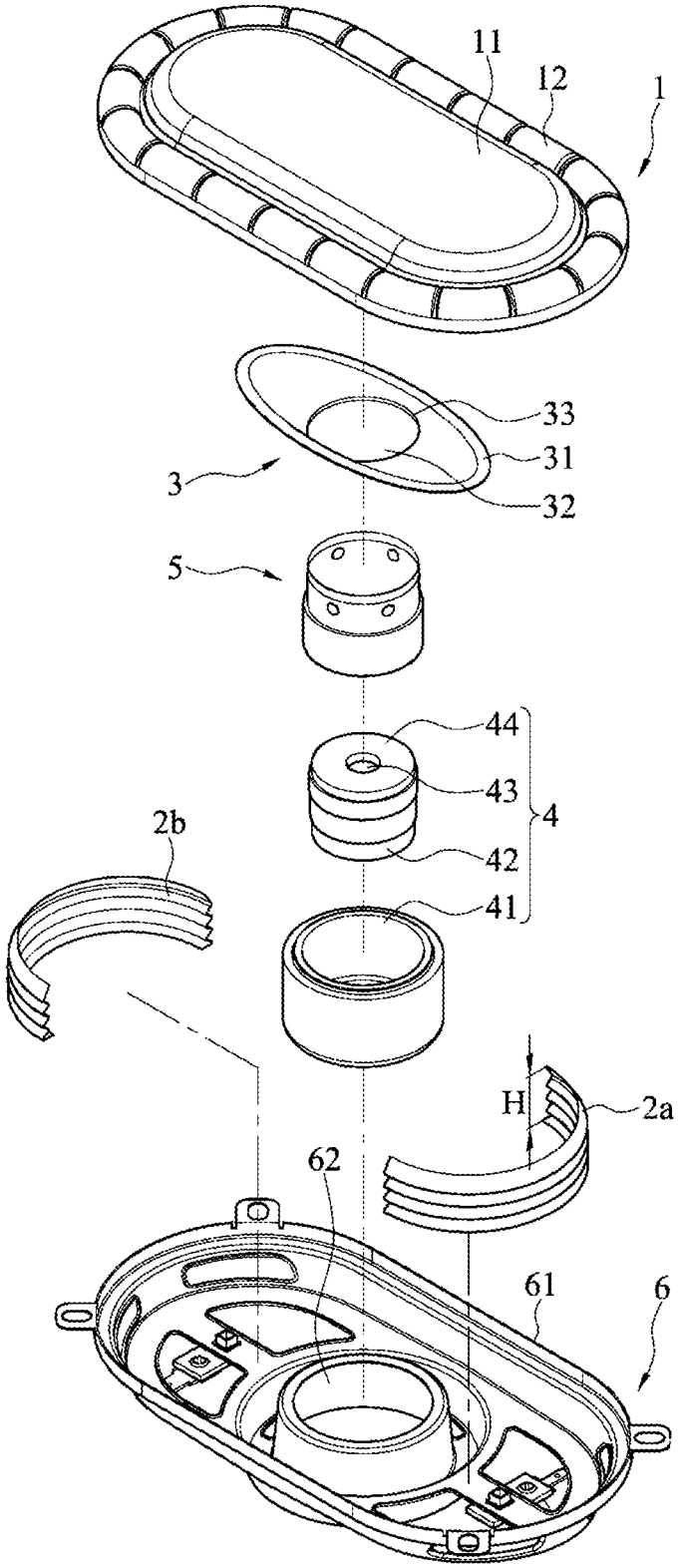
FIG. 2 is a schematic perspective exploded view of an embodiment of a moving-coil loudspeaker according to this disclosure.

Referring to FIG. 1 in combination with FIG. 2, FIG. 1 is a schematic perspective view of an embodiment of a moving-coil loudspeaker according to this disclosure. FIG. 2 is a schematic exploded perspective view of an embodiment of a moving-coil loudspeaker according to this disclosure. The embodiments of the moving-coil loudspeaker depicted in FIG. 1 and FIG. 2 include a vibrating diaphragm 11, a suspension 1, a voice coil 5, a magnetic circuit 4, and a support 6. The vibrating diaphragm 11 is hung on the support 6 by using the suspension 1, and the suspension 1 includes a surround 12 and a first spider 2*a*. A section view of the surround 12 has an inverted U-shape, and one side (referred to as a first end 121 below) of the surround 12 is connected to an outer surface of the vibrating diaphragm 11. The first spider 2*a* vertically stands below a connection between the surround 12 and the vibrating diaphragm 11, and one side (an upper side) of the first spider 2*a* is connected to an inner surface (a lower surface) of the vibrating diaphragm 11. The voice coil 5 is located below the center of the vibrating diaphragm 11, the magnetic circuit 4 is located below the voice coil 5, and the support 6 supports the magnetic circuit 4. When the voice coil 5 is powered, a magnetic induction force is generated to drive the voice coil 5 for vibrating and producing a sound by the vibrating diaphragm 11. A desirable effect of vibration absorbing may be provided by means of configuration of the first spider 2*a* vertically standing below the vibrating diaphragm 11. Moreover, the size of the entire loudspeaker may be reduced to be more applicable to a small-size product.

Figure 3:
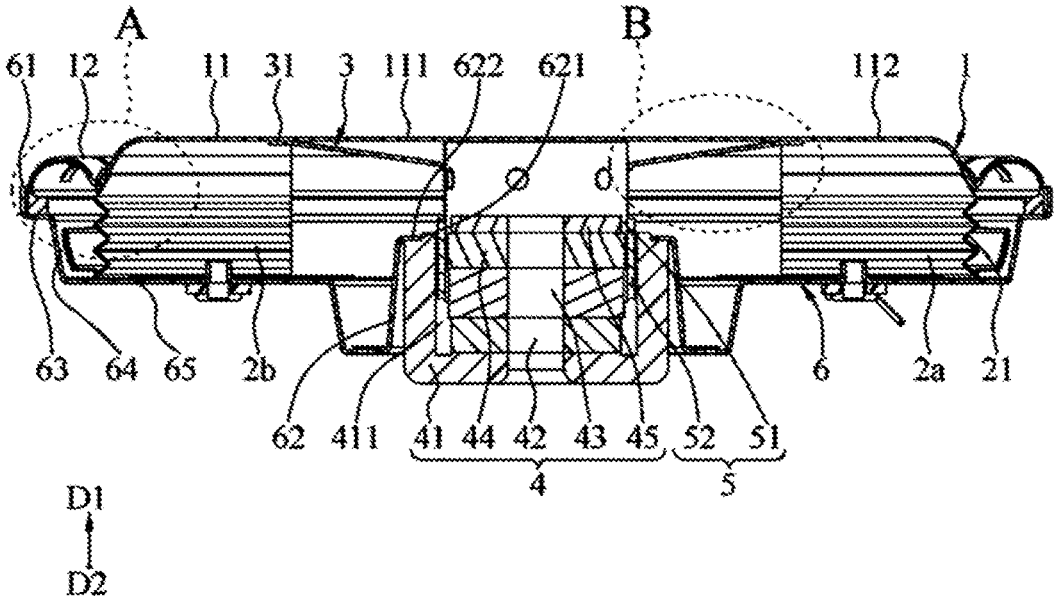
FIG. 3 is a schematic sectional view of a moving-coil loudspeaker according to this disclosure.

Referring to FIG. 3, in an embodiment, the vibrating diaphragm 11 has an inner surface 111 and an outer surface 112 that are opposite to each other. A direction perpendicular to the inner surface 111 or the outer surface 112 of the vibrating diaphragm 11 is defined as a vertical direction D1. A direction that starts from the outer surface 112 and upward along the vertical direction D1 is an upward direction, and a direction that starts from the inner surface 111 and downward along the vertical direction D1 is a downward direction. As shown in FIG. 2, two ends of a peripheral shape of the vibrating diaphragm 11 are semicircular, and the vibrating diaphragm 11 is formed, but not limited to, a long ellipse shape. The peripheral shape of the vibrating diaphragm 11 may alternatively be ellipse-shaped, egg-shaped, circular, or any other similar shape.

Further referring to FIG. 3, a direction perpendicular to the vertical direction D1 is defined as a horizontal direction D2. From the horizontal direction D2, the periphery of the vibrating diaphragm 11 is an arc and extends downward such that the outer surface 112 of the vibrating diaphragm 11 is connected to one side (the first end 121) of the surround 12. The inner surface 111 within a periphery range of the arc of the vibrating diaphragm 11 is a plane.

Figure 4:
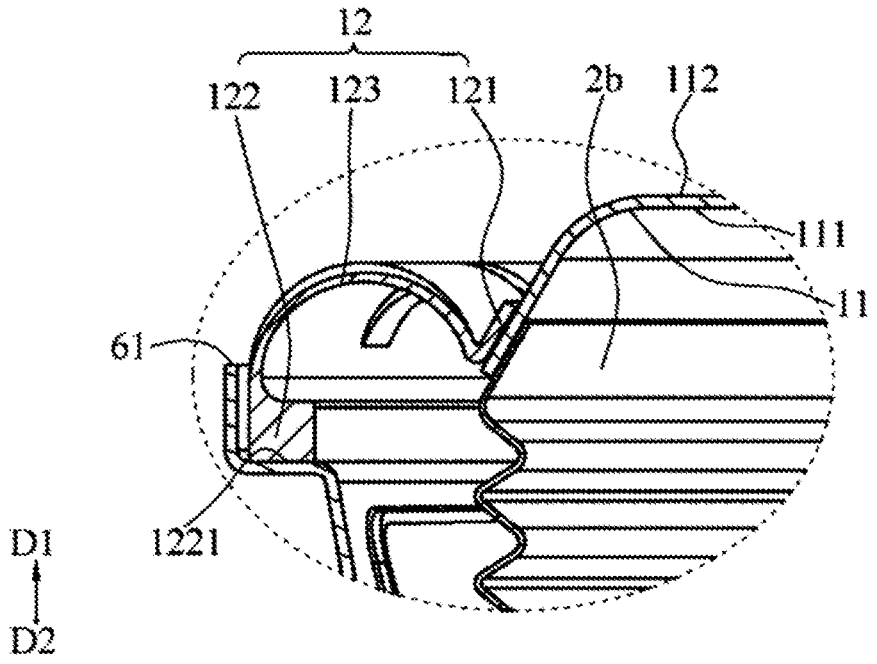
FIG. 4 is a partial enlarged view according to part "A" in FIG. 3.

Referring to FIG. 3 in combination with FIG. 4, FIG. 4 is a partial enlarged view of part "A" in FIG. 3. Herein, the surround 12 is disposed at the outer surface 112 along the periphery of the vibrating diaphragm 11. The surround 12 has the first end 121 and a second end 122 that are opposite to each other, and a buffer portion 123 located between the first end 121 and the second end 122. The first end 121 of the surround 12 is connected to the outer surface 112 of the vibrating diaphragm 11. From the horizontal direction D2, a section of the buffer portion 123 between the first end 121 and the second end 122 of the surround 12 is inverted U-shaped.

Further referring to FIG. 4, more specifically, a part between the first end 121 of the surround 12 and the buffer portion 123 faces upward and is an inverted U-shaped arc. The second end 122 is thickened to form a step shape and, therefore, a section view of the second end 122 is rectangular and has an abutting surface 1221 to flatly abut against the support 6.

Further referring to FIG. 2 and FIG. 3, the first spider 2*a* is a semicircular arc plate having a wavy structure. The first spider 2*a* extends along the vertical direction D1 to vertically stand below a connection between the surround 12 and the vibrating diaphragm 11, and one side (an upper side) of the first spider 2*a* is connected to the inner surface 111 of the vibrating diaphragm 11. In an embodiment, as viewed from the vertical direction D1, the first spider 2*a* is semicircular and is located on one end of the vibrating diaphragm 11. In addition, the first spider 2*a* has a plurality of bending portions 21. In an embodiment, the height H of the first spider 2*a* is approximately 15 mm.

Similarly, referring to FIG. 2 and FIG. 3, the voice coil 5 is located below the center of the vibrating diaphragm 11. In this embodiment, the voice coil 5 is vertically below the inner surface 111 of the vibrating diaphragm 11. Further, the voice coil 5 of this embodiment includes a bobbin 51 and a coil 52, and the bobbin 51 is circular column-shaped. The coil 52 is wound around one end on the periphery of the bobbin 51, and the other end of the bobbin 51 abuts against the inner surface 111 of the vibrating diaphragm 11. Therefore, when the coil 52 of the voice coil 5 generates a magnetic field, the voice coil 5 vibrates and is thus capable of transmitting kinetic energy to the vibrating diaphragm 11 and the surrounding air, so that a sound is produced.

Similarly, referring to FIG. 2 and FIG. 3, the magnetic circuit 4 is located below the voice coil 5, and there is a magnetic gap between the magnetic circuit 4 and the voice coil 5. The magnetic circuit 4 includes a U-shaped yoke 41, a prop-up body 42, a main magnetic body 43, a washer 44, and a backing magnetic body 45. The U-shaped yoke 41 is made of a material with magnet conductivity and has an interior space 411. The interior space 411 goes through the U-shaped yoke 41 to become a part of the magnetic circuit as an external magnetic pole, and enables magnetic field lines to smoothly flow through the U-shaped yoke 41. The prop-up body 42, the main magnetic body 43, the washer 44, and the backing magnetic body 45 are sequentially laminated at a central position of the interior space 411 of the U-shaped yoke 41. The main magnetic body 43 is may be made of a permanent magnet, and the backing magnetic body 45 is also made of a material with magnet conductivity.

Further referring to FIG. 3, more specifically, the U-shaped yoke 41 of the magnetic circuit 4 is sleeved over an outer side of the coil 52 of the voice coil 5. That is, the coil 52 of the voice coil 5 is located in the interior space 411 of the U-shaped yoke 41. Herein, there is a magnetic gap between the coil 52 and the U-shaped yoke 41. The prop-up body 42, the main magnetic body 43, the washer 44, and the backing magnetic body 45 of the magnetic circuit 4 extend into the bobbin 51 of the voice coil 5, and the coil 52 of the voice coil 5 is disposed at a central position of the magnetic gap. In this way, the voice coil 5 can move in the magnetic gap between the U-shaped yoke 41 and the main magnetic body 43.

Referring to FIG. 2 and FIG. 3, in an embodiment, the magnetic circuit 4 is supported by the support 6. The support 6 includes an edge 61. The outline of the edge 61 corresponds to the outline of the surround 12, and the edge 61 of the support 6 is connected to the other side (the second end 122) of the surround 12. More specifically, the support 6 is a disk-shaped structure having an opening facing upward, and the outline of the support 6 corresponds to the outline of the surround 12. The support 6 further includes a sheath base 62 that is located at a central position of the support 6. In addition, the support 6 further includes a joint portion 63, a slant surface 64, and a supporting portion 65. The joint portion 63 extends along the edge 61 of the support 6. The slant surface 64 is connected between the joint portion 63 and the supporting portion 65 and enables the joint portion 63 and the supporting portion 65 to be located at different height positions in the vertical direction. In addition, in the horizontal direction D2, the supporting portion 65 is closer to the sheath base 62 compared with the joint portion 63.

Further, referring to FIG. 3, two ends of the sheath base 62 are not coplanar with the supporting portion 65. That is, the two ends of the sheath base 62 separately extend to above and below the support 6 with respect to the supporting portion 65. The sheath base 62 has a through hole 621 and a surrounding abutment surface 622 facing downward. The U-shaped yoke 41 of the magnetic circuit 4 abuts against the surrounding abutment surface 622 of the sheath base 62 from below the support 6. The prop-up body 42, the main magnetic body 43, the washer 44, and the backing magnetic body 45 of the magnetic circuit 4 extend into the voice coil 5 from the through hole 621 of the sheath base 62.

When the coil 52 of the voice coil 5 is powered, a current passes through the coil 52 and generates a magnetic field. The magnetic field of the voice coil 5 interacts with the magnetic field of the magnetic circuit 4 to generate a magnetic induction force to drive the voice coil 5 to vibrate, thereby driving the surrounding air to produce a sound. The first spider 2*a* supports the vibrating diaphragm 11, so that the vibrating diaphragm 11 and the voice coil 5 are prevented from deviation, and it is ensured that the voice coil 5 remains to be located in the gap between the U-shaped yoke 41 and the main magnetic body 43. In this way, reciprocating kinetic energy of the voice coil 5 under the effect of the magnetic field is maintained. Configuration of the first spider 2*a* in the form of the semicircular arc plate improves degrees of freedom of manufacturing and assembling.

Further referring to FIG. 4, the first end 121 of the surround 12 is adhered to the outer surface 112 of the vibrating diaphragm 11, and the second end 122 of the surround 12 is adhered to the joint portion 63 of the support 6 by means of the surrounding abutment surface 1221. The surround 12 is joined with the vibrating diaphragm 11 and the support 6 by means of the two ends, so that a buffer effect of the buffer portion 123 is ensured. The thickened second end 122 may increase a joint area between the surround 12 and the support 6 so as to improve the bonding stability of the surround 12.

Similarly, referring to FIG. 2, in an embodiment, the vibrating diaphragm 11 includes a major axis X1 and a minor axis X2, and the first spider 2*a* is located on one end of the major axis X1. In another embodiment, a second spider 2*b* is further included. The second spider 2*b* and the first spider 2*a* have a same structure feature. That is, the second spider 2*b* is also a semicircular arc plate having a wavy structure formed by a plurality of bending portions 21, and also vertically stands below a connection between the vibrating diaphragm 11 and the surround 12. The second spider 2*b* is located at the other end of the major axis X1 of the vibrating diaphragm 11. That is, the first spider 2*a* and the second spider 2*b* are located at line-symmetry positions of the vibrating diaphragm 11 with respect to the minor axis X2. Therefore, the first spider 2*a* and the second spider 2*b* are separately disposed on two ends of the major axis X1 of the vibrating diaphragm 11 to stably support the vibrating diaphragm 11, so that the vibrating diaphragm 11 can produce a sound more stably.

Further, because the first spider 2*a* and the second spider 2*b* are semicircular arc plates and are separately located on two ends of the major axis X1 of the vibrating diaphragm 11, the vibrating diaphragm 11 can be supported as long as it spans the first spider 2*a* and the second spider 2*b*. It should be noted that a spider is usually placed in a horizontal plane below a vibrating diaphragm, but in an embodiment of the present invention, the spider stands vertically. The vibrating diaphragm 11 in this disclosure spans the first spider 2*a* and the second spider 2*b*. In an embodiment of the present invention, the vibrating diaphragm 11 is supported at two positions. Therefore, the shape of the vibrating diaphragm 11 is not limited and the area of the vibrating diaphragm 11 may be increased. When the area of the vibrating diaphragm 11 is increased, a dynamic state of the voice coil may be simultaneously improved, and the quality of output audio is improved. Furthermore, the vibrating diaphragm 11 of the present invention is supported by the first spider 2*a* and the second spider 2*b*, and the vibrating diaphragm 11 between the first spider 2*a* and the second spider 2*b* is in a hanging state. Therefore, smoothness of the vibrating diaphragm 11 may be increased, so that a vibration stroke of the vibrating diaphragm 11 is substantially increased to better provide a mega bass characteristic.

Figure 5:
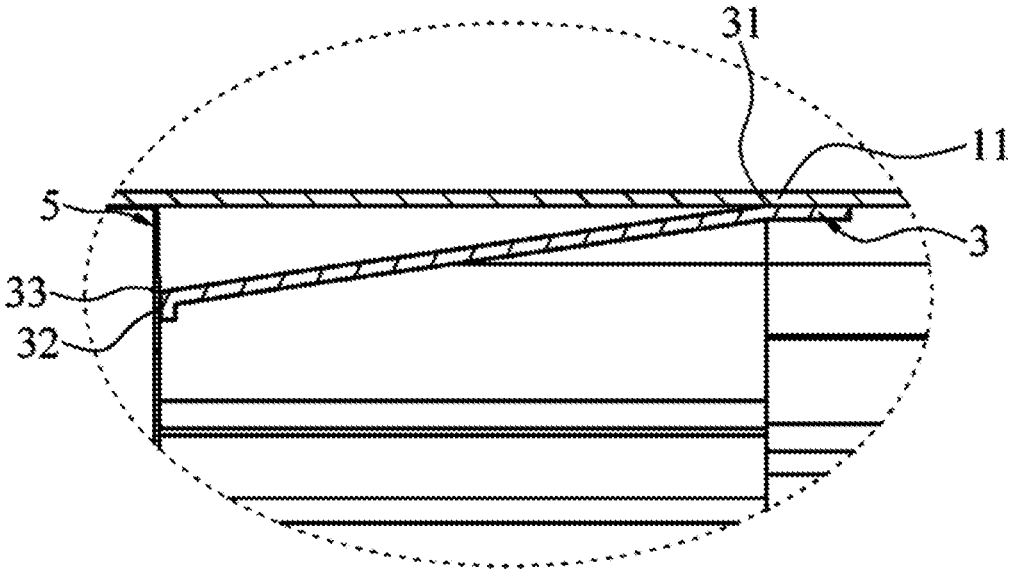
FIG. 5 is a partial enlarged view according to part "B" in FIG. 3.

In an embodiment, referring to FIG. 2 in combination with FIG. 3 and FIG. 5, a support cup 3 is further included between the vibrating diaphragm 11 and the voice coil 5. The entire support cup 3 has a long-elliptical cone-shape. The support cup 3 includes an upper opening edge 31, a central hole 32, and a central edge 33. The upper opening edge 31 of the support cup 3 is greater than the central edge 33 of the central hole 32, and the upper opening edge 31 of the support cup 3 faces toward the central hole 32 and gradually contracts to the central edge 33. In this embodiment, the upper opening edge 31 of the support cup 3 is connected to the inner surface 111 of the vibrating diaphragm 11, and the central edge 33 of the central hole 32 is connected to the bobbin 51 of the voice coil 5. Therefore, the connection between the voice coil 5 and the vibrating diaphragm 11 is enhanced by the support cup 3, and the kinetic energy of the voice coil 5 is more definitely transmitted to the vibrating diaphragm 11. The voice coil 5 is maintained in position during vibration, ensuring that the voice coil 5 reciprocates in the magnetic gap between the U-shaped yoke 41 and the main magnetic body 43.

According to the present invention, the semicircular first spider 2*a* and/or the second spider 2*b* vertically standing below the surround 12 and the vibrating diaphragm 11 can make the entire loudspeaker very thin, increase the stroke, achieve a mega bass characteristic, and still maintain desirable sound quality.

Although this application is disclosed as above by using the embodiments, the embodiments are not intended to limit this specification. Any person skilled in the art can make some variations and modifications without departing from the spirit and scope of this application. Therefore, the protection scope of this application should be subject to the scope defined by the appended claims.

What is claimed is:

1. A suspension, used for supporting a vibrating diaphragm, comprising:

a surround with an inverted U-shape in a section view, and the surround having one side connected to an outer surface of the vibrating diaphragm; and a first spider located below a connection between the surround and the vibrating diaphragm and extending from the connection along a vertical direction of the vibrating diaphragm, the first spider having one side connected to an inner surface of the vibrating diaphragm.

2. The suspension according to claim 1, wherein the vibrating diaphragm has a long ellipse-shape, wherein the surround encircles a periphery of the vibrating diaphragm, wherein an other side of the surround is thickened to form a step shape, and wherein the first spider is located on one end of a major axis of the long ellipse-shape of the vibrating diaphragm.

3. The suspension according to claim 2, wherein the suspension comprises a second spider located on an other end of the major axis of the long ellipse-shape of the vibrating diaphragm, and the second spider vertically stands below a connection between the surround and the vibrating diaphragm.

4. The suspension according to claim 3, wherein the first spider and the second spider are waved arc plates.

5. The suspension according to claim 1, wherein the first spider is half ring-shaped.

6. A moving-coil loudspeaker, comprising:

a vibrating diaphragm;

a suspension, comprising:

a surround with an inverted U-shape in a section view, the surround having one side connected to an outer surface of the vibrating diaphragm; and a first spider located below a connection between the surround and the vibrating diaphragm and extending from the connection along a vertical direction of the vibrating diaphragm, the first spider having one side connected to an inner surface of the vibrating diaphragm;

a voice coil, located below a center of the vibrating diaphragm;

a magnetic circuit, located below the voice coil, wherein a magnetic gap is disposed between the magnetic circuit and the voice coil, a coil on the voice coil is disposed at a central position of the magnetic gap, and after the voice coil is powered on, a generated magnetic induction force drives the voice coil to vibrate and produce a sound by using the vibrating diaphragm; and a support, supporting the magnetic circuit and comprising an edge, the edge corresponding to the surround and being connected to an other side of the surround.

7. The moving-coil loudspeaker according to claim 6, wherein the vibrating diaphragm has a long ellipse-shape, wherein the surround encircles a periphery of the vibrating diaphragm, wherein the other side of the surround is thickened to form a step shape to be connected to the edge, and wherein the first spider is disposed on one end of a major axis of the long ellipse-shape of the vibrating diaphragm.

8. The moving-coil loudspeaker according to claim 7, wherein the moving-coil loudspeaker comprises a second spider disposed on an other end of the major axis of the long ellipse-shape of the vibrating diaphragm, and the second spider vertically stands below a connection between the surround and the vibrating diaphragm.

9. The moving-coil loudspeaker according to claim 8, wherein the first spider and the second spider are waved arc plates.

10. The moving-coil loudspeaker according to claim 6, further comprising a support cup, comprising:

a central hole; and a central edge;

wherein the voice coil is located at the central hole and the central edge is connected to the voice coil.

11. The moving-coil loudspeaker according to claim 10, wherein an entirety of the support cup has a long, elliptical cone shape, the support cup further comprising an upper opening edge connected to an inner surface of the vibrating diaphragm.

12. The suspension according to claim 1, wherein the vibrating diaphragm has a long ellipse-shape.

13. The suspension according to claim 1, wherein the surround encircles a periphery of the vibrating diaphragm.

14. The suspension according to claim 1, wherein an other side of the surround is thickened to form a step shape.

15. The suspension according to claim 1, wherein the first spider is located on one end of a major axis of the vibrating diaphragm.

16. The suspension according to claim 15, further comprising a second spider located on an other end of the major axis.

17. The suspension according to claim 16, wherein the first spider and the second spider are independent components.

18. The suspension according to claim 16, wherein the first spider and the second spider are each half ring-shaped.

* * * * *